US006171005B1

(12) United States Patent
Kuo

(10) Patent No.: US 6,171,005 B1
(45) Date of Patent: Jan. 9, 2001

(54) CALENDAR PEN

(76) Inventor: Wen-Jui Kuo, 7F, No. 8, Alley 11, Lane 183, Sec. 1, Ho Ping E. Road (TW)

( * ) Notice: Under 35 U.S.C. 154(b), the term of this patent shall be extended for 0 days.

(21) Appl. No.: 09/559,935

(22) Filed: Apr. 27, 2000

(51) Int. Cl.[7] ..... B43K 29/00
(52) U.S. Cl. ..... 401/195; 401/52
(58) Field of Search ..... 401/52, 195, 194

(56) References Cited

U.S. PATENT DOCUMENTS 3,785,076 * 1/1974 Swensson ..... 40/335
3,810,325 * 5/1974 Koper ..... 40/335
4,292,750 * 10/1981 Zuffellato ..... 401/195

FOREIGN PATENT DOCUMENTS

30137 * 6/1981 (EP) ..... 401/52
2252182 * 7/1992 (GB) ..... 401/195

* cited by examiner

*Primary Examiner*—Henry J. Recla
*Assistant Examiner*—Tuan Nguyen
(74) *Attorney, Agent, or Firm*—Ostrolenk, Faber, Gerb & Soffen, LLP

(57) ABSTRACT

A calendar pen has an outer cover having multiple windows and multiple first indicators formed thereon, an inner cover rotatably received in the outer cover and having multiple rows of marks peripherally formed thereon and each corresponding to the windows and a rotator rotatably mounted on the inner cover and having a plurality of second indicators selectively aligning with the arrow of the outer cover, such that a user will have the exact date of the day by just rotating different part of the pen.

4 Claims, 3 Drawing Sheets

CALENDAR PEN

FIELD OF THE INVENTION

The present invention relates to a calendar pen, and more particularly to a calendar pen enabling a user to know the exact date, month and year. The pen has an outer cover provided with multiple windows in the periphery thereof, an inner cover rotatably received in the outer cover and having a series of marks that stand for the date of the week and a rotator rotatably connected with the outer cover and having a series of marks that stand for the months of the year, such that with the relative among the outer cover, inner cover and the rotator, the user is able to keep track of the exact date, month of the year without checking through the calendar from time to time.

Description of Related Art

Normally, a pen is only used in writing and not other function whatsoever. However, due to different requirement of various users, keeping track of the exact date of the week, the month or even the year is quite important to some users. Therefore, some users will have a pocket calendar to provide the exact date at any time necessary. As we all know that carrying a pocket calendar is not convenient for the users who travel a lot. Because light weight and easy-to-go luggage is the most important factor to a person who travels a lot, such that carrying a pocket calendar will only add a burden to the person. To overcome the shortcomings, the present invention tends to provide an improved pen to mitigate and obviate the aforementioned problems.

SUMMARY OF THE INVENTION

The main objective of the invention is to provide an improved pen having an outer cover provided with multiple windows defined in an outer periphery thereof, an inner cover rotatably received in the outer cover and having series of marks thereon and a rotator rotatably connected with the outer cover and having a plurality of marks that stand for the month of the year, such that with the relative rotation among the outer cover, the inner cover and the rotator, the user is able to know the exact date of the day.

Other objects, advantages and novel features of the invention will become more apparent from the following detailed description when taken in conjunction with the accompanying drawings.

DETAILED DESCRIPTION OF PREFERRED EMBODIMENT

Figure 1:
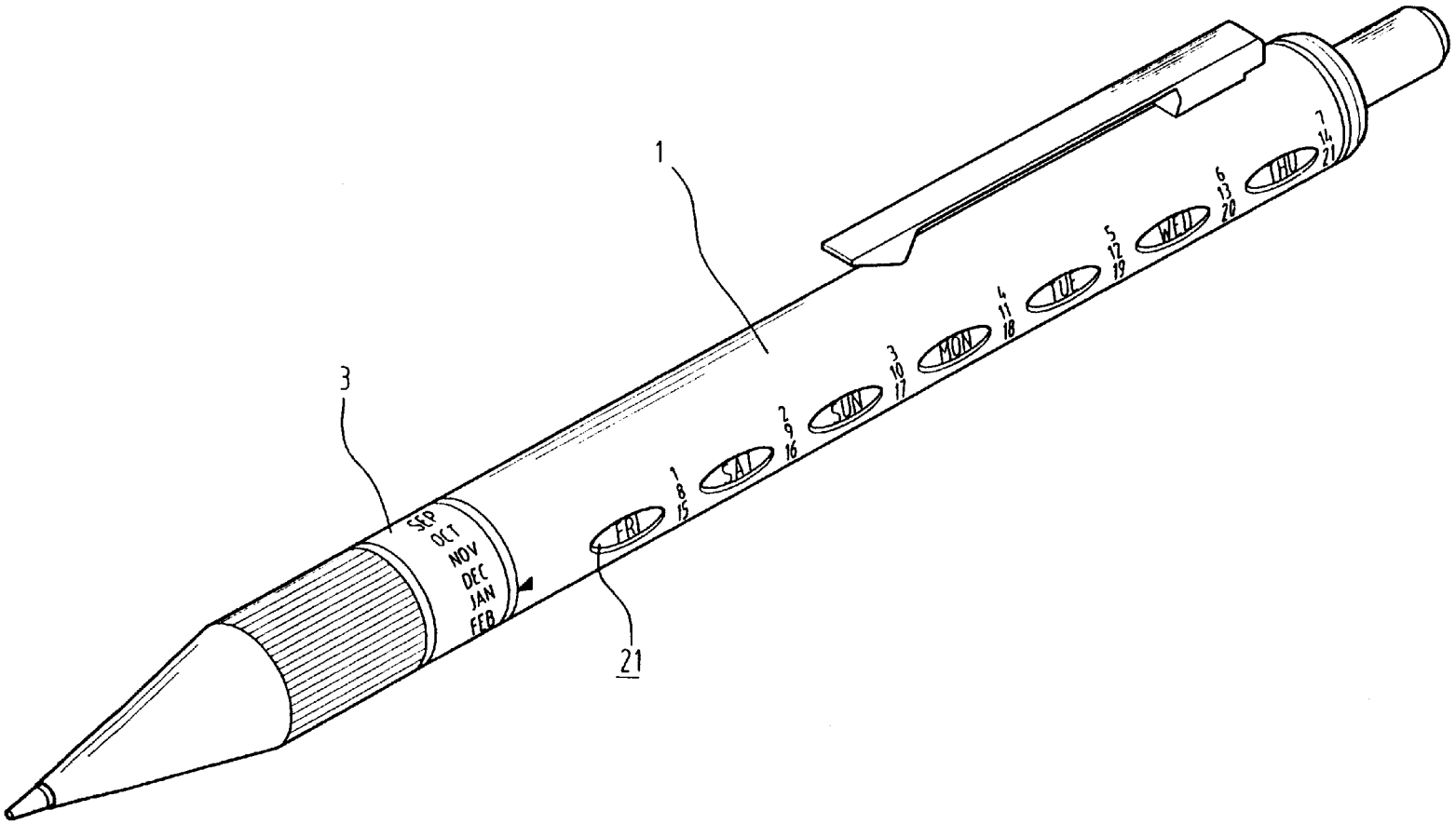
FIG. 1 is a perspective view of the calendar pen constructed in accordance with the present invention.
Figure 2:
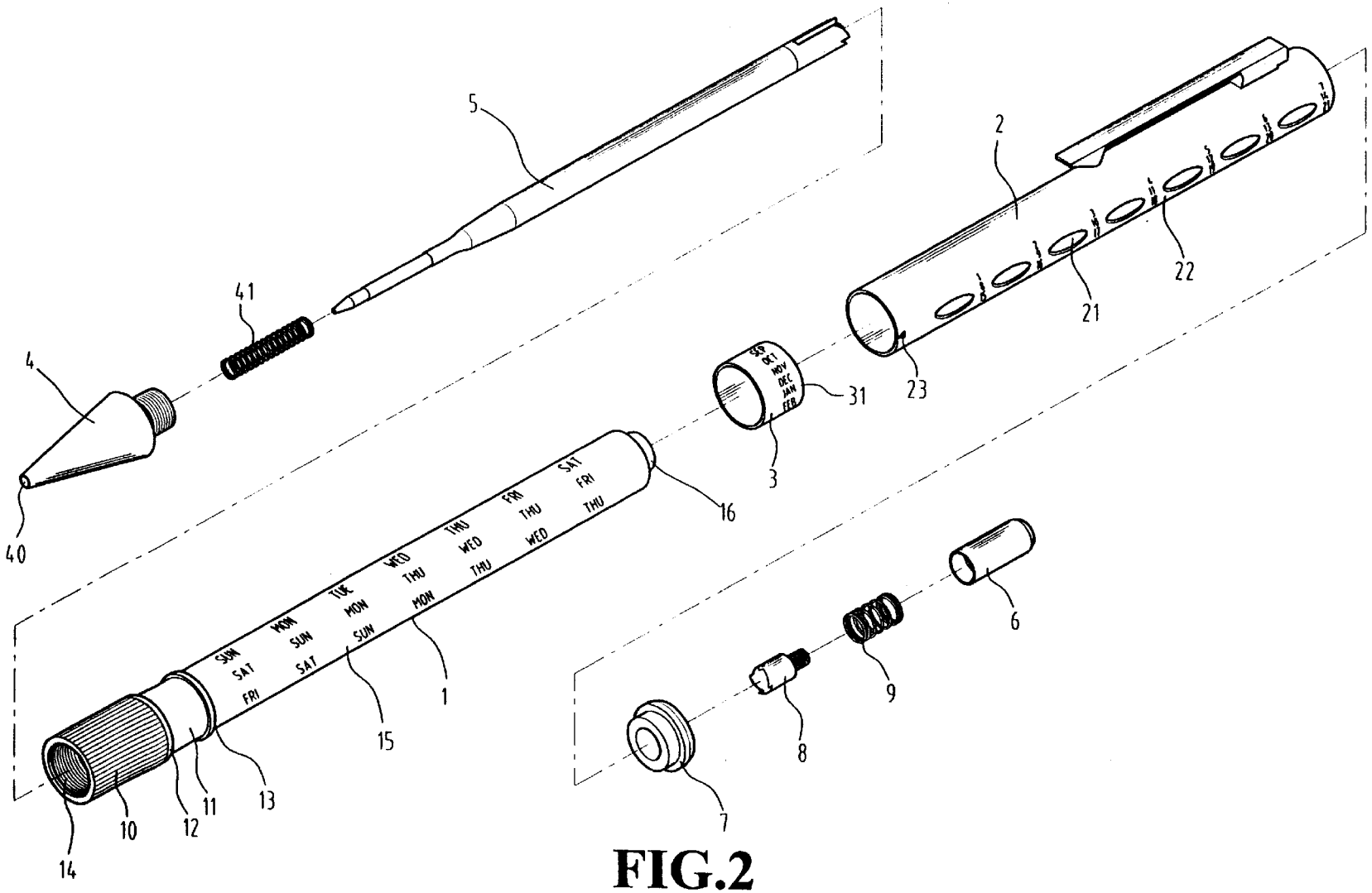
FIG. 2 is an exploded perspective view showing the parts of the calendar pen of FIG. 1.
Figure 3:
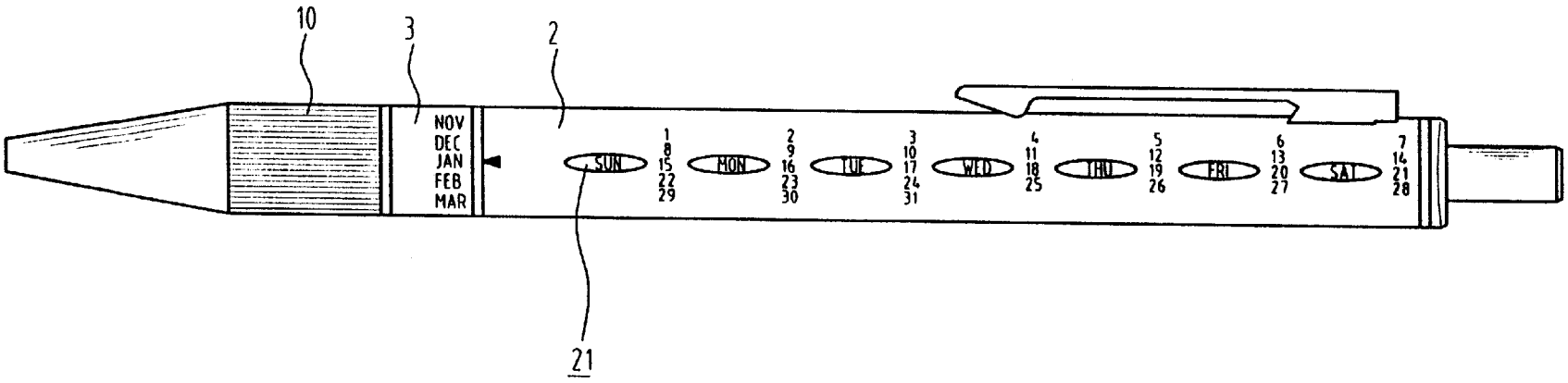
FIG. 3 is a side plan view showing the application of the calendar pen of the invention.

With reference to FIG. 1 and FIG. 2, a calendar pen constructed in accordance with the present invention has an inner cover 1, an outer pen 2 having the inner cover 1 rotatably received therein, a rotator 3 rotatably mounted on the inner cover 1, a cone-headed cover 4 threadingly connected with an end of the inner cover 1 and a core 5 securely received in the inner cover 1 and the cone-headed cover 4.

The inner cover 1 has two flanges 12,13, a space 11 defined between the two flanges 12,13, a threaded hole 14 defined adjacent to a pattern area 10 which is peripherally formed 20 on the outer surface of the inner cover 1, multiple rows of marks 15 peripherally formed on the inner cover 1 and each being the date of the week, an extension 16 integrally extending out therefrom and having a diameter smaller than that of the inner cover 1.

The outer cover 2 has multiple windows 21 defined in line in the periphery thereof, multiple first indicators 22 peripherally formed thereon and each being the number of the month and an arrow 23 formed near one end thereof. The windows 21 each corresponds to one row of the marks 15 of the inner cover 1.

The rotator 3 rotatably received between the flanges 12,13 and has multiple second indicators 31 annularly formed on the outer periphery thereof.

The cone-headed cover 4 has a threaded head corresponding to the threaded hole 14 of the inner cover 1, such that when the pen of the invention is assembled, the cone-headed cover 4 is able to be screwed onto the threaded hole 14 of the inner cover 1. The cone-headed cover 4 further has a hole 40 defined in one end thereof and a spring 41 compressibly received between the cone-headed cover 4 and the inner cover 1. The core 5 has an end having a diameter slightly smaller that of the hole 40 of the cone-headed cover 4, such that the end of the core 5 is able to selectively extend out from the hole 40.

The calendar pen of the invention further has a controlling device to control the core 5 to selectively extend out from the hole 40. The controlling device comprises a positioning disk 7, a control member 8, a spring 9 and a cap 6, which are sequentially inserted in the outer cover 2. However, because the function and movement of the controlling device is conventional in the art, detailed description thereof is omitted.

When the calendar pen of the invention is in assembly, the spring 41 is inserted into the cone-headed cover 4 and then the cone-headed cover 4 is screwed onto the inner cover 1. The core 5 is then inserted into the inner cover 1 and the cone-headed cover 4. Because the material chosen to make the rotator 3, the rotator 3 is able to slide over the flange 13 or 12 and receive in the space 11 between the flanges 12,13. Thereafter, the outer cover 2 allows the inner cover 1 to be received therein until the end having the arrow 23 engages the flange 13. The controlling device, of course, is assembled in the outer cover 2 before the inner cover 1 is inserted into the outer cover 2.

After assembly, the user is able to hold the pattern area 10 and rotate the rotator 3 to align one of the second indicators 31 with the arrow 23 of the outer cover 2. Thereafter, the user holds the rotator 3 and the outer cover 2 and rotates the pattern area 10 to align one of the marks 15 that stands for the date of the week with one of the windows 22 that has a first indicator 22 corresponding to the first indicator 31. After the rotation of the parts of the pen is finished, the user then has a pen that is able to indicate the date of the week and the month of he year.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A calendar pen comprising:

an outer cover having multiple windows defined therein, an arrow formed on an edge thereof and multiple first indicators each peripherally formed to correspond to one of the windows;

an inner cover rotatably received in the outer cover and having multiple rows of marks each peripherally formed to correspond to the windows; and a rotator rotatably mounted at the joint between the outer and inner covers and having multiple second indicators each selectively corresponding to the arrow of the outer cover;

a core securely received in the inner cover;

a cone-headed cover threadingly connected with one end of the inner cover; and means for activating the core to selectively extend out from the cone-headed cover;

wherein the first indicators each represent the day of a month;

wherein the marks each represent the day of a week; and wherein second indicators each represent the months.

2. The pen as claimed in claim 1, wherein the inner cover has two flanges and a space defined between the two flanges for receiving the rotator therein.

3. The pen as claimed in 2, wherein the inner cover further comprises a pattern area formed for facilitating holding and a threaded hole for engaging with the cone-headed cover.

4. The pen as claimed in claim 1, wherein the activating means comprises a positioning disk, a control member, a spring and a cap, which are sequentially inserted in the outer cover.

* * * * *